United States Patent [19]

Schaft

[11] Patent Number: 4,882,853

[45] Date of Patent: Nov. 28, 1989

[54] APPARATUS FOR CURING COATINGS APPLIED TO A MEMBER

[76] Inventor: Volker Schaft, Barkenkoppel 38, 2000 Hamburg 65, Fed. Rep. of Germany

[21] Appl. No.: 244,127

[22] Filed: Sep. 14, 1988

[30] Foreign Application Priority Data

Sep. 15, 1987 [DE] Fed. Rep. of Germany ..... 3730879
Jan. 12, 1988 [DE] Fed. Rep. of Germany ..... 3800628

[51] Int. Cl.[4] ..... F26B 19/00
[52] U.S. Cl. ..... 34/68; 34/41; 34/4
[58] Field of Search ..... 34/17, 18, 68, 4, 39, 34/40, 41, 90; 101/424.1

[56] References Cited

U.S. PATENT DOCUMENTS 3,409,460 11/1968 Mitchel et al. ..... 34/4 X
4,693,013 9/1987 Pabst et al. ..... 34/41 X

*Primary Examiner*—Henry A. Bennet
*Assistant Examiner*—John Sollecito
*Attorney, Agent, or Firm*—Becker & Becker, Inc.

[57] ABSTRACT

An apparatus for curing, by drying and/or hardening, layers or coatings, such as printing colors or inks, laminations, etc., that are continuously successively applied to a member. The lowermost, pigment-containing layers are subjected to a thermal treatment via IR radiation, and the uppermost or cover layer, which forms a lamination, is exposed to UV radiation. The air above that region of the coated member that is subjected to the UV radiation is withdrawn and is blown onto that region of the member that is subjected to IR radiation.

17 Claims, 3 Drawing Sheets

APPARATUS FOR CURING COATINGS APPLIED TO A MEMBER

BACKGROUND OF THE INVENTION

The present invention relates to an apparatus for curing, by drying and/or hardening, layers or coatings, such as printing colors or inks, laminations, etc., that are continuously successively applied to a member. The lowermost, pigment-containing layers are subjected to a thermal treatment via IR radiation, and the uppermost or cover layer, which forms a lamination, is exposed to UV radiation.

IR-reactive colors or inks are being used more and more frequently in the printing industry. These colors, inks, and lacquers dry very rapidly at the surface when irradiated with IR radiation, and are thus dry to the touch and to dust. In order to be able to further treat a carrier member such as paper or cardboard that has been printed with such colors, for example by improving the surface quality of the carrier member with an acrylate coating or lamination, the IR-reactive colors must be completely and thoroughly dried, since otherwise the printing pattern is spoiled due to the fact that the wet color portions run below the lamination in the material of the carrier member. It should be noted that the thorough drying of IR-reactive colors can in extreme cases take several hours.

It is therefore an object of the present invention to provide a method and apparatus with which IR-reactive colors can be intensely dried in such a way that the post treatment of the printed-upon carrier member, for example a lamination thereof, can be undertaken immediately, i.e. without a transition time, after the IR-treatment without impairing the printing pattern.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
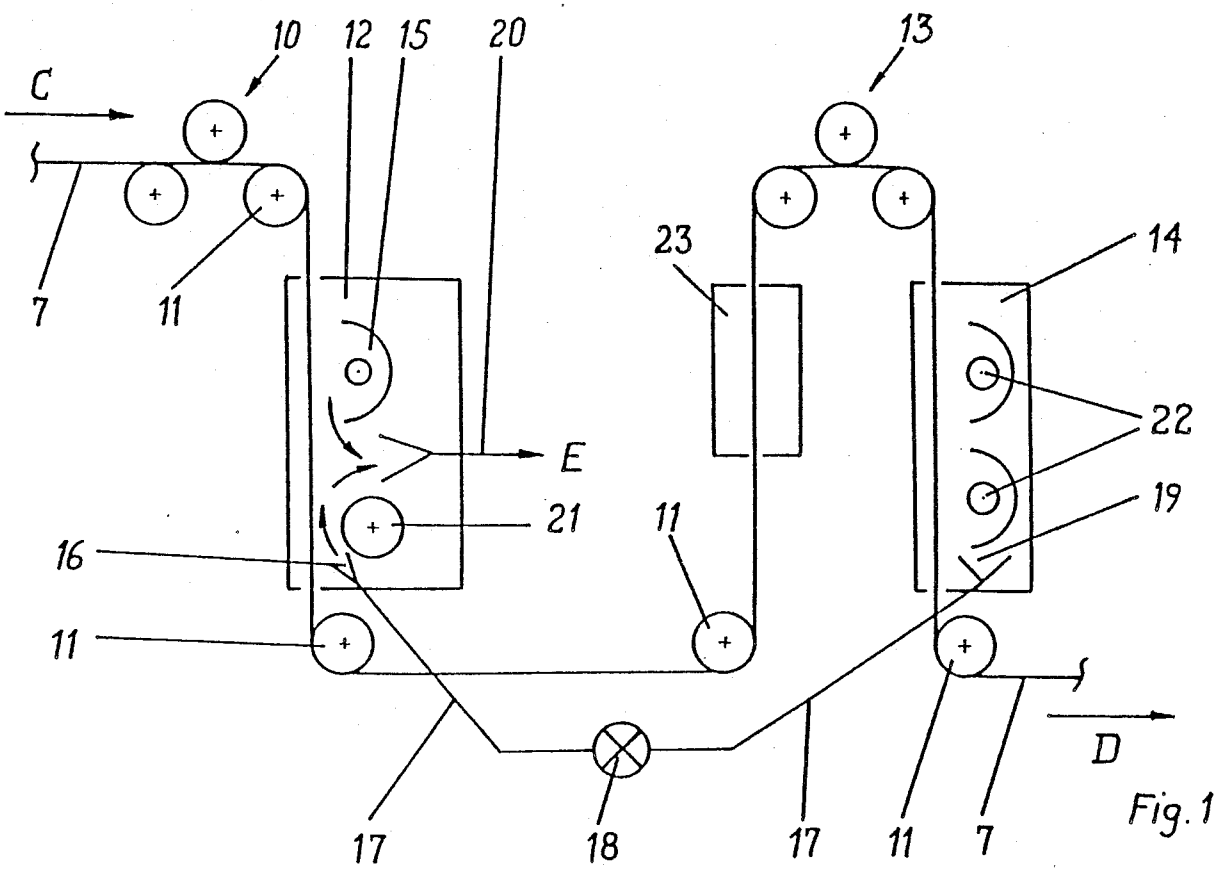
FIG. 1 is a schematic side view of the discharge end of a rotary printing press.

The method of tee present invention is characterized primarily in that the air above that region of the coated member that is subjected to the UV radiation is withdrawn and is blown into the IR drying mechanism in that region of the member that is subjected to the IR radiation.

As a result of the inventive withdrawal of the air from that region of the coated member that is subjected to the UV radiation, and subjecting that region of the member that is subjected to IR radiation with this withdrawn air, the IR-reactive printing color that is to be dried is, in addition to the IR radiation, also acted upon by ozone-rich air. As a result of these measures, the oxidation processes that take place during the drying of the color or ink are accelerated in such a way that the color is thoroughly dried in a minimum amount of time, and the printing pattern is not negatively altered by the lamination.

The additional enrichment of the vicinity of that region of the printed-upon member that is exposed to the IR radiation with ozone also effects an oxidation of the solvent expelled from the color by the IR radiation, as a result of which the environment is not polluted.

The apparatus of the present invention for carrying out the inventive method comprises: an IR drying mechanism that is disposed downstream of the last printing mechanism, of a printing press, for applying IR-reactive colors; a UV-radiation mechanism disposed downstream of a mechanism for applying a lacquer-like UV-reactive coating to the IR-treated printing colors on the member; and means for introducing exhaust air from the UV-radiation mechanism into the IR drying mechanism.

The apparatus of the present invention makes it possible to carry out the inventive method for curing coatings applied to a member without great capital outlay with existing printing presses by introducing the exhaust air line from the UV-radiation mechanism into the IR drying mechanism. At the same time, post treatment mechanisms, with which in particular the solvent expelled from the color would be separated out, can be dispensed with for the exhaust air from the IR drying mechanism, this exhaust air being the entire exhaust air of the printing press; this contributes to a reduction of the operating costs of the printing press while increasing the printing capacity due to the rapid drying of the color or ink in the IR drying mechanism.

In order to improve or ensure the positive effects upon the drying of the IR-reactive colors, which positive effects originate from the ozone or active oxygen of the exhaust air from the UV-radiation mechanism, there is disposed, pursuant to a preferred embodiment of the inventive apparatus, in the IR drying mechanism, downstream of an IR-radiation member when viewed in the direction of transport of the printing press, an ozone generator, preferably a rod-shaped high pressure glow discharge lamp, especially a mercury-vapor lamp, that, accompanied by the formation of an annular chamber, is surrounded by a metal or ceramic jacket, the wall of which is provided with openings out of which air, preferably a portion of the exhaust air from the UV-radiation mechanism, and which was blown into the annular chamber, escapes in the direction toward the color layer or layers that are to be treated. As a result of this arrangement of this specially embodied high pressure glow discharge lamp within the IR drying mechanism, the printing color or ink is subjected not only to an additional IR radiation, which is emitted by the jacket that is heated by the mercury-vapor lamp. Rather, due to the additional inventive measures, the ozone content in the IR drying mechanism, which ozone content originates from the exhaust air of the UV-radiation mechanism, is also increased. This additional ozone passes with the air from the annular space between the jacket and the mercury-vapor lamp, via the openings in the jacket wall, into the IR drying device and is blown against the surface of the printed-upon member. In so doing, the ozone is formed in the annular chamber from the atmospheric oxygen due to the UV radiation emitted by the mercury-vapor lamp. It would also be possible to provide an additional exhaust mechanism in the IR drying device to act upon the region between the IR-radiation member and the glow discharge lamp; this contributes to an intimate contact of the ozone with the color that is to be dried.

Pursuant to further specific embodiments of the ozone generator, the jacket and/or channels thereof can be made of a non-oxidizable material, of a material having catalytic properties for generating ozone, preferably from atmospheric oxygen, or of a material that converts short wave radiation, especially UV radiation, into thermal radiation.

Further specific features of the present invention will be described in detail subsequently.

DESCRIPTION OF PREFERRED EMBODIMENTS

Referring now to the drawings in detail, the object or member 7 that is to be printed on or coated enters in the direction of the arrow C, into the last printing mechanism 10 for infrared or IR-reactive colors at the discharge end of the printing press illustrated in FIG. 1; the member 7 leaves the printing press in the direction of the arrow D. Along this path, the member 7 travels past guide rollers 11 and passes an IR drying mechanism 12, a squeezing and blowing mechanism 23, a coating mechanism 13 for an ultraviolet or UV-reactive acrylate coating, and a UV-radiation mechanism 14.

Disposed in the IR drying mechanism 12 are an IR-radiation member 15 directed upon the member 7, and an ozone generator 21, the construction of which will be described subsequently with the aid of FIGS. 2 and 3. Also extending into the IR drying mechanism 12 is the discharge opening 16 of an air line 17 in which is disposed a blower 18. The inlet opening 19 of the air line 17 is disposed in the UV-radiation mechanism 14. The air is withdrawn from the IR drying mechanism 12 in the direction of the arrow E into the atmosphere via an exhaust channel 20

The UV-radiation mechanism 14 is provided with two high pressure glow discharge lamps 22 that irradiate the member 7.

Figure 2:
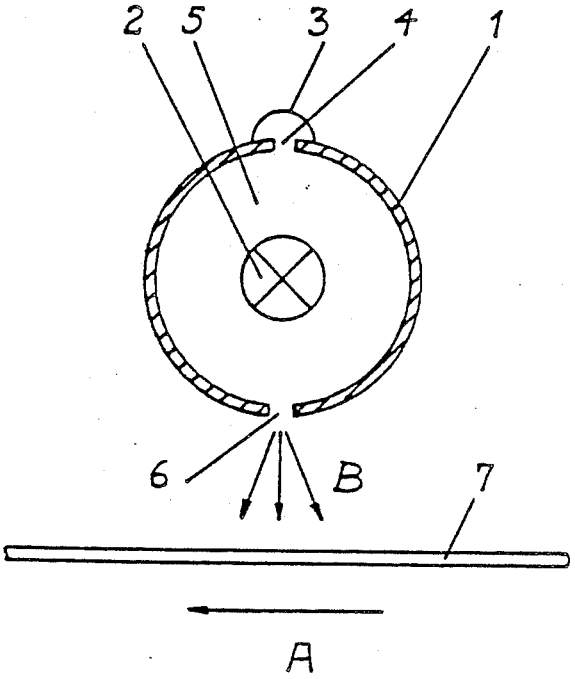
FIG. 2 is a schematic cross-sectional view through a first exemplary embodiment of an inventive ozone generator disposed in the IR drying mechanism of the printing press of FIG. 1.

The ozone generator 21 of the IR drying mechanism 12 illustrated in FIG. 2 comprises a ceramic jacket 1 in which is concentrically disposed a rod-shaped mercury-vapor lamp 2. The length of the jacket 1 corresponds to the length of the mercury-vapor lamp 2. Disposed on the outside of the jacket 1 is an air-collecting channel 3 that communicates via air inlet openings 4 in the wall of the jacket 1 with an annular chamber 5 that is delimited by the jacket 1 and the mercury-vapor lamp 2. In addition, disposed across from the air inlet openings 4 in the wall of the jacket 1 is a slot-like air outlet opening 6 that extends over the entire length of the jacket 1. The air outlet opening 6 is directed against the printed-upon member 7, which passes by in the direction of the arrow A.

Figure 3:
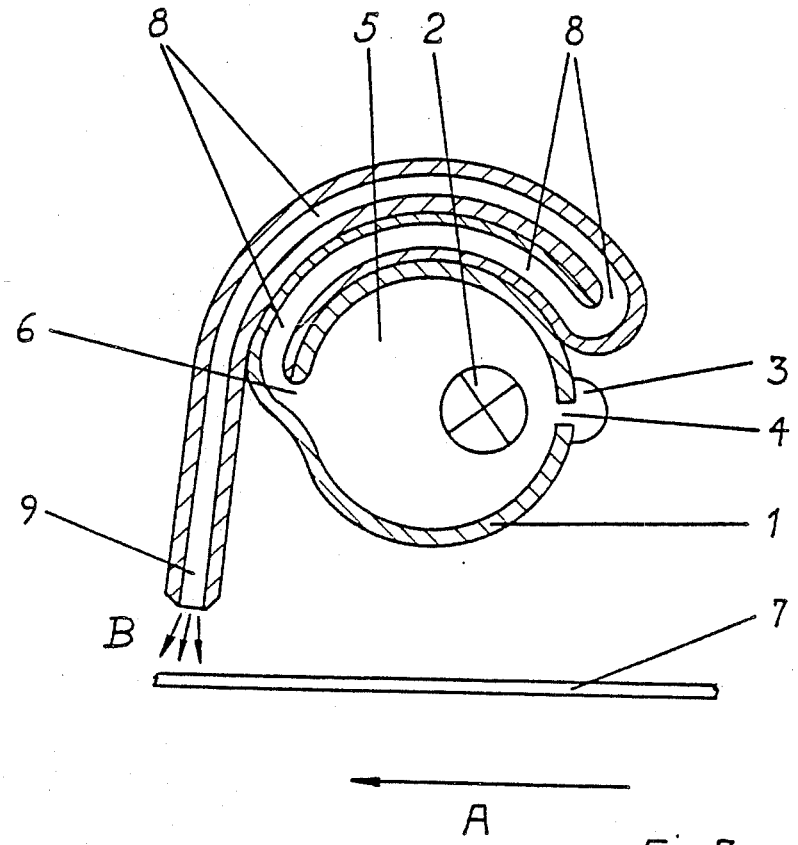
FIG. 3 is a schematic cross-sectional view through a further exemplary embodiment of an inventive ozone generator disposed in the IR drying mechanism of the printing press of FIG. 1.

In the embodiment of the ozone generator 21 of the IR drying mechanism 12 illustrated in FIG. 3, the rod-like mercury-vapor lamp 2 is eccentrically disposed in the ceramic jacket 1, the length of which essentially corresponds to the length of the lamp 2, and the air-collecting channel 3 is disposed on the side of the jacket 1 relative to the member 7, which passes the ozone generator 21 in the direction of the arrow A. The air-collecting channel 3 communicates with the annular chamber 5 via air inlet openings 4 in the wall of the jacket 1. The annular chamber 5 merges into a channel 8 via a slot-like opening 6 that is disposed approximately across from the air inlet openings 4. This channel 8 has a zigzagged shape, and is guided in a curved manner along the outside of that region of the ceramic jacket 1 that is remote from the color layer or layers that are to be treated. The channel 8 has an outlet 9 that is directed against these color layer or layers, and that is embodied as an air jet.

The manner of operation of the inventive apparatus is briefly described as follows:

The high pressure glow discharge lamps 22 in the UV-radiation mechanism 14 emit not only UV-radiation that initiates the curing reaction of the acrylate coating. These lamps 22 also provide an ozone-rich atmosphere, since only a portion of the ozone formed from the atmospheric oxygen under the effect of the UV radiation reacts with the acrylate coating during curing thereof. This excess ozone, instead of being emitted as pollutant into the a atmosphere, is inventively drawn off by the blower 18 along with the air from the UV-radiation mechanism 14, and is then introduced via the air line 17 into the IR drying mechanism 12, where it is converted as a reaction-ready oxidizing agent during drying of the IR-reactive printing color or ink by the radiation emitted from the IR-radiation member 15. In addition to the IR-radiation member 15 and the ozone from the UV-radiation mechanism 14, the ozone generator 21 also contributes to the drying of the IR-reactive color, and especially to the oxidation of the expelled solvent in the IR drying mechanism 12. This contribution of the ozone generator 21 is realized in that the wall of the jacket 1 of the generator 21 that is heated by the mercury-vapor lamp 2 transmits IR radiation onto the moving member 7. At the same time, a non-illustrated fan blows ambient air into the air-collecting channel S, with this air passing via the air inlet openings 4 into the annular chamber 5, in which the air is exposed to the UV-radiation of the mercury-vapor lamp 2. This UV-radiation converts a portion of the atmospheric oxygen into ozone. The now ozone-rich air leaves the annular chamber 5 via the air outlet opening 6 and, in the direction of the arrows B, strikes the color surfaces of the member 7 that are to be dried. As a result, there is formed in the space between the IR-radiation member 15 and the ozone generator 21 in the IR drying mechanism 12 an atmosphere that is essentially free of solvent, since the solvent, which was released during the drying of the IR-reactive colors, was converted into harmless products, especially by the ozone. The exhaust gases from the IR drying mechanism 12 are subsequently withdrawn in the direction of the arrow E into the atmosphere, free of pollutants, via a non-illustrated exhaust mechanism and via the exhaust channel 20.

In the embodiment of the ozone generator illustrated in FIG. 3, the air that is exposed to the UV-radiation in the annular chamber 5 strikes the color layer or layers that are to be treated only after it has passed through the labyrinth-like channel 8. This contributes to increasing the ozone-forming effect of the UV-radiation, which is guided into the channel 8 via the air outlet opening 6 by reflection. The rear region of the jacket 1, relative to the coated member 7, is cooled by the inventive channel configuration. In this connection, that region of the jacket 1 that is remote from the member 7 and acts as an IR emitter, experiences only a slight cooling effect from the air blown out of the outlet 9 of the channel 8 against the member 7, so that the intensity of the radiation of this remote region of the jacket 1 is barely adversely affected.

Before the printed-upon member 7 enters the coating mechanism 13 for the acrylate coating, it passes the squeezing and blowing mechanism 23, in which ozone that still adheres, in particular to the dry IR-reactive printing dye, is removed.

The present invention is, of course, in no way restricted to the specific disclosure of the specification and drawings, but also encompasses any modifications within the scope of the appended claims.

WHAT I CLAIM IS:

1. An apparatus for curing, by drying and/or hardening, layers or coatings, such as printing colors or inks, laminations, etc., that are continuously successively applied to a member, said apparatus comprising:

an IR drying mechanism that is disposed downstream of the last printing mechanism, of a printing press, for applying IR-reactive colors to said member;

a UV-radiation mechanism disposed downstream of a mechanism for applying a lacquer-like UV-reactive coating to said IR-treated printing colors on said member; and means for introducing exhaust air from said UV-radiation mechanism into said IR drying mechanism.

2. An apparatus according to claim 1, in which said IR drying mechanism comprises an IR-radiation member, and downstream thereof, as viewed in the direction of transport of said member through said printing press, an ozone generator that is provided with a wall that forms a jacket that defines an annular chamber, with said wall being provided with opening means from which air blown into said annular chamber escapes in a direction toward said pigment-treated member.

3. An apparatus according to claim 2, in which said ozone generator includes a rod-shaped high pressure glow discharge lamp.

4. An apparatus according to claim 3, in which said lamp is a mercury-vapor lamp.

5. An apparatus according to claim 2, in which said jacket is made of metal.

6. An apparatus according to claim 2, in which said jacket is made of ceramic.

7. An apparatus according to claim 2, in which said opening means of said wall of said jacket opens into channel means that is disposed in a zig-zagged manner on an outside region of said wall remote from said member, with said channel means being provided with an outlet that is directed against said member.

8. An apparatus according to claim 7, in which said outlet of said channel means is embodied as an air jet.

9. An apparatus according to claim 7, in which said ozone generator includes a high pressure glow discharge lamp that is eccentrically disposed in said annular chamber.

10. An apparatus according to claim 2, which includes an exhaust mechanism that acts upon a region between said IR-radiation member and said ozone generator.

11. An apparatus according to claim 2, in which said opening means of said wall of said jacket is in the form of at least one slot that extends over the entire length of said jacket.

12. An apparatus according to claim 7, in which said jacket and/or said channel means is made of a non-oxidizable material.

13. An apparatus according to claim 7, in which said jacket and/or channel means is made of a material having catalytic properties for generating ozone.

14. An apparatus according to claim 13, in which said material has catalytic properties for generating ozone from atmospheric oxygen.

15. An apparatus according to claim 7, in which said jacket and/or channel means is made of a material that converts short wave radiation into thermal radiation.

16. An apparatus according to claim 15, in which said material converts UV-radiation into thermal radiation.

17. An apparatus according to claim 2, in which said ozono generator includes a mercury vapor lamp that is concentrically disposed in said annular chamber.

* * * * *